US006026623A

United States Patent [19]

Anderson

[11] Patent Number: 6,026,623

[45] **Date of Patent: *Feb. 22, 2000**

[54] BUILDING COMPONENT

[75] Inventor: Keith James Hunter Anderson, Oxfordshire, United Kingdom

[73] Assignee: Bolt Wade & Tennant, London, United Kingdom

[ * ] Notice: This patent issued on a continued prosecution application filed under 37 CFR 1.53(d), and is subject to the twenty year patent term provisions of 35 U.S.C. 154(a)(2).

[21] Appl. No.: 08/856,688

[22] Filed: May 15, 1997

[30] Foreign Application Priority Data

May 14, 1996 [GB] United Kingdom ..... 9610158

[51] Int. Cl.[7] ..... E04B 1/36; E04F 15/22

[52] U.S. Cl. ..... 52/480; 52/730.6; 52/737.7; 52/745.05; 52/745.1; 52/745.13; 52/747.1

[58] Field of Search ..... 52/480, 730.6, 52/731.7, 737.7, 745.05, 745.1, 745.13, 747.1

[56] References Cited

U.S. PATENT DOCUMENTS

| | | | |
|---|---|---|---|
| 2,115,238 | 4/1938 | Stevens | 52/480 X |
| 3,553,919 | 1/1971 | Omholt | 52/480 X |
| 4,709,517 | 12/1987 | Mitchell et al. . | |
| 4,838,000 | 6/1989 | Ljungkvist . | |
| 5,369,927 | 12/1994 | Counihan . | |
| 5,377,471 | 1/1995 | Niese . | |

FOREIGN PATENT DOCUMENTS

| | | |
|---|---|---|
| 0 067 134 A2 | 12/1982 | European Pat. Off. . |
| 0 453 415 A1 | 10/1991 | European Pat. Off. . |
| 132271 | 11/1920 | United Kingdom . |
| 132270 | 12/1920 | United Kingdom . |
| 340943 | 1/1931 | United Kingdom . |
| 432362 | 7/1935 | United Kingdom . |
| 466476 | 5/1937 | United Kingdom . |
| 1002735 | 8/1965 | United Kingdom . |
| 1003931 | 9/1965 | United Kingdom . |
| 1 309 231 | 3/1973 | United Kingdom . |

(List continued on next page.)

OTHER PUBLICATIONS

"Westbourne Acoustic Cradle Flooring System", Durabella Limited brochure, July 1994.

"Broadstairs and Broadstairs Cradle System", Durabella Limited brochure, March 1987.

British Board of Agre'ment Assessment of Products for Constructions Brochure for Contiwood (Durabella) Ltd dated 1987.

Durabella Flooring Systems "Laying Instructions"for Westbourne Flooring Systems, brochure, May 1986.

"Danskin Royal Saddle Flooring System", brochure, May 1988.

Photographs showing two forms of Danskin Royal Saddle, admitted prior art.

*Primary Examiner*—Christopher T. Kent

*Attorney, Agent, or Firm*—Westman Champlin & Kelly P.A.

[57] ABSTRACT

There is described a building component in combination with one or more spacers. The building component comprises a base element adapted to be positioned on a surface of a building structure and a pair of mutually spaced side members which project from the base element to define a longitudinal channel for the receipt of a supporting batten to which a further surface layer may be secured. The building component is adapted to allow the insertion of the or each spacer between the base element and the supporting batten in the direction transverse to the longitudinal channel.

There is also described a spacer comprising a base section and a pair of mutually spaced side walls in which the base section of the spacer is adapted to overlie the base element of the building component and extend transversely of the longitudinal channel.

There is also described a building component comprising one or more frangible regions spaced at intervals along the length of the channel.

20 Claims, 10 Drawing Sheets

FOREIGN PATENT DOCUMENTS

| | | |
|---|---|---|
| 1 478 850 | 7/1977 | United Kingdom . |
| 2 002 678 | 2/1979 | United Kingdom . |
| 1 548 646 | 7/1979 | United Kingdom . |
| 2 126 265 | 3/1984 | United Kingdom . |
| 2 135 628 | 9/1984 | United Kingdom . |
| 2 185 045 | 7/1988 | United Kingdom . |
| 2 279 676 | 1/1995 | United Kingdom . |
| 2 272 232 | 2/1995 | United Kingdom . |
| 2 284 835 | 6/1995 | United Kingdom . |
| 2 286 611 | 8/1995 | United Kingdom . |
| 2 292 396 | 2/1996 | United Kingdom . |
| WO 92/12306 | 7/1992 | WIPO . |
| WO 95/14137 | 5/1995 | WIPO . |

BUILDING COMPONENT

BACKGROUND OF THE INVENTION

The present invention relates to a building component and in particular to a component for use in the formation of a floor, wall or ceiling, and to floors, walls or ceilings made using the component. The present invention also relates to a method of constructing a floor, wall or ceiling.

In the past, the general method of laying a floor has been to first lay a number of floor supporting beams or battens and then to apply a flooring layer on top of the battens to form the floor's surface. In modern constructions it is frequently the case that a basic concrete structure is provided over which it is desired to lay a floor spaced a short distance from the concrete. Some walls and ceilings are made in the same way and one can find many instances of false walls and ceilings which are spaced a short distance from an underlying sub-structure suspended ceilings are a particularly widespread example.

The state of the art in so far as it relates to flooring is outlined in GB 2,126,265 in which there is described a flooring component which is intended to be located on the structural member over which the floor is to be laid. The flooring component comprises a pair of base elements on the upper surface of which there is mounted a pair of spaced, longitudinally extending support members. The base elements and support members together define a cradle which is adapted to accommodate a support batten over which the flooring layer is to be applied. A resilient material is mounted on a lower surface of the base element such that in use the resilient material contacts the underlying structural member while levelling of the support batten is effected by interposing spacers between the base element and an underside of the support batten.

A modification of the above flooring component is disclosed in GB 2,185,048 in which there is described an arrangement in which the pair of support members are each formed with a discontinuity. In this way a channel is provided capable of accommodating a second support batten extending generally at right angles to the first.

Despite this improvement, there are nevertheless a number of problems associated with the flooring components of the prior art. For example, as GB 2,185,048 makes clear, the pair of support members are typically formed of a rigid material such as wood or metal and are therefore incapable of flexing to accommodate support battens of differing widths. Indeed, if the support batten has a width which is greater than the distance between the support members, the batten simply will not fit into the cradle. Likewise, if the support batten has a width which is significantly less than the distance between the side support members, there will be a tendency for the batten to move laterally within the cradle and thereby act as a source of additional noise as people, or objects, move, or are moved, over the overlying flooring layer.

Likewise, the only way of adjusting the height of the supporting batten is by inserting spacers between the batten and the cradle in the longitudinal direction of the batten. This means that if the support batten is not at the correct height it must first be lifted out of the cradle to allow a spacer to be inserted before the support batten is then reintroduced into the cradle and the height reassessed. It would be far more convenient if a method could be found of introducing spacers between the base element and the supporting batten which did not require the supporting batten to be continually lifted out of the cradle.

In addition, in the past any spacers that were introduced between the supporting batten and the cradle were held in position by adhesive. This of course meant that it was not possible to reposition or remove a spacer for any reason once it had been inserted.

Furthermore, because the prior art flooring components are formed of three or more elements, each of a different material, the time and cost involved in their construction is significant. In view of this it would also be desirable to provide a less expensive building component and preferably one that could be adapted on site for the particular application concerned.

Occasionally it is desirable to raise the height of the floor a significant distance above the underlying structural member so as to allow, for example, the introduction of one or more layers of insulating material between the floor and the structural member. These materials may possess acoustic and/or thermal insulating properties and be required in order to meet building regulations. Nevertheless, it is clearly not desirable to raise the floor more than is necessary and so the distance separating the floor and the underlying structural member is preferably matched to the required thickness of the insulating material. Such thickness is, of course, dependent upon the desired performance of the floor, and so varies substantially between different applications. However, in the prior art, this floor raising has been achieved in one of two ways.

Firstly, the supporting cradles have been manufactured with a base of a thickness appropriate to raise the floor the necessary height. However, this is inconvenient as it involves the manufacture of a number of different sized cradles. Additionally, the end user cannot easily alter spacing between the floor and the underlying structural member on site should an alternate spacing be required from that originally envisaged.

The second way of increasing the spacing between the floor and the underlying structural member has been by using a standard size flooring component and simply inserting numerous thin packing spacers between the base element and the supporting batten until the desired height is achieved. However, in order to achieve a rigid supporting structure, these spacers must inconveniently be firmly nailed or glued together. Even then the total thickness of the spacers cannot be more than that which would raise the support batten above the level of the support members and leave the batten with no lateral support.

SUMMARY OF THE INVENTION

According to a first aspect of the present invention there is provided a building component in combination with one or more spacers, the building component comprising a base element adapted to be positioned on a surface of a building structure and a pair of mutually spaced side members which project from the base element to define a longitudinal channel for the receipt of a supporting batten to which a further surface layer may be secured, the building component being adapted to allow the insertion of the or each spacer between the base element and the supporting batten in a direction transverse to the longitudinal channel.

According to a second aspect of the present invention there is provided a building component in combination with a spacer, the building component comprising a base element adapted to be positioned on a surface of a building structure and a pair of mutually spaced side members which project from the base element to define a longitudinal channel, and the spacer comprising a base section and a pair of mutually spaced side walls, the base section of the spacer being adapted to overlie the base element of the building component.

According to a third aspect of the present invention there is provided a building component comprising a base element adapted to be positioned on a surface of a building structure; a pair of mutually spaced aide members which project from the base element to define a longitudinal channel for the receipt of a supporting batten to which a further surface layer may be secured; and one or more frangible regions spaced at intervals along the length of the channel.

According to a fourth aspect of the present invention there is provided a floor, wall or ceiling comprising a plurality of building components and spacers, each building component comprising a base element adapted to be positioned on a surface of a building structure and a pair of mutually spaced side members which project from the base element to define a longitudinal channel, each building component being adapted to allow the insertion of one or more spacers between the base element and the supporting batten in a direction transverse to the longitudinal channel, said building components being positioned in a plurality of spaced rows over a surface of a building structure and longitudinally spaced within each row with the channels aligned to define a longitudinal batten path, one or more supporting battens disposed along said batten path, one or more spacers interposed between said supporting battens and said building components, and one or more elements of a surface layer secured to the supporting batten to form said floor, wall or ceiling.

According to a fifth aspect of the present invention there is provided a floor, wall or ceiling comprising a plurality of building components and spacers, each building component comprising a base element adapted to be positioned on a surface of a building structure and a pair of mutually spaced side members which project from the base element to define a longitudinal channel, and each spacer comprising a base section and a pair of mutually spaced side walls, the base section of each spacer being adapted to overlie the base element of an associated building component, said building components being positioned in a plurality of spaced rows over a surface of a building structure and longitudinally spaced within each row with the channels aligned to define a longitudinal batten path, one or more supporting battens disposed along said batten path, one or more spacers interposed between said supporting battens and said building components, and one or more elements of a surface layer secured to the supporting batten to form said floor, wall or ceiling.

According to a sixth aspect of the present invention there is provided a floor, wall or ceiling comprising a plurality of building components, each building component comprising a base element adapted to be positioned on a surface of a building structure, a pair of mutually spaced side members which project from the base element to define a longitudinal channel, and one or more frangible regions spaced at intervals along the length of the channel, said building components being positioned in a plurality of spaced rows over a surface of a building structure and longitudinally spaced within each row with the channels aligned to define a longitudinal batten path, one or more supporting battens disposed along said batten path, and one or more elements of a surface layer secured to the supporting battens to form said floor, wall or ceiling.

According to a seventh aspect of the present invention there is provided a method of constructing a floor, wall or ceiling comprising the steps of positioning in a plurality of spaced rows over a surface of a building structure a plurality of building components and spacers, each building component comprising a base element adapted to be positioned on a surface of a building structure and a pair of mutually spaced side members which project from the base element to define a longitudinal channel, each building component being adapted to allow the insertion of one or more spacers between the base element and the supporting batten in a direction transverse to the longitudinal channel; spacing the building components longitudinally within each of said rows and aligning the channels defined by the building components so as to define a longitudinal batten path; inserting one or more supporting battens along said batten path; inserting one or more spacers between said supporting battens and said building components in a direction transverse to said batten path; and securing one or more elements of a surface layer to the supporting battens to form said floor, wall or ceiling.

According to an eighth aspect of the present invention there is provided a method of constructing a floor, wall or ceiling comprising the steps of positioning in a plurality of spaced rows over a surface of a building structure a plurality of building components and spacers, each building component comprising a base element adapted to be positioned on a surface of a building structure and a pair of mutually spaced side members which project from the base element to define a longitudinal channel, and each spacer comprising a base section and a pair of mutually spaced side walls, the base section of each spacer being adapted to overlie the base element of an associated building component; spacing the building components longitudinally within each of said rows and aligning the channels defined by the building components so as to define a longitudinal batten path; inserting one or more supporting battens along said batten path; inserting one or more spacers between said supporting battens and said building components in a direction transverse to said batten path; and securing one or more elements of a surface layer to the supporting battens to form said floor, wall or ceiling.

According to a ninth aspect of the present invention there is provided a method of constructing a floor, wall or ceiling comprising the steps of providing a plurality of building components, each building component comprising a base element adapted to be positioned on a surface of a building structure, a pair of mutually spaced side members which project from the base element to define a longitudinal channel, and one or more frangible regions spaced at intervals along the length of the channel, reducing one or more of the building components to the desired length by breaking one or more of said frangible regions; positioning said building components in a plurality of spaced rows over a surface of a building structure; spacing the building components longitudinally within each of said rows and aligning the channels defined by the building components so as to define a longitudinal batten path; inserting one or more supporting battens along said batten path; and securing one or more elements of a surface layer to the supporting battens to form said floor, wall or ceiling.

BRIEF DESCRIPTION OF THE DRAWINGS

A number of embodiments of the present invention will now be described by way of example with reference to the accompanying drawings in which.

DETAILED DESCRIPTION OF THE ILLUSTRATIVE EMBODIMENTS

Figure 1:
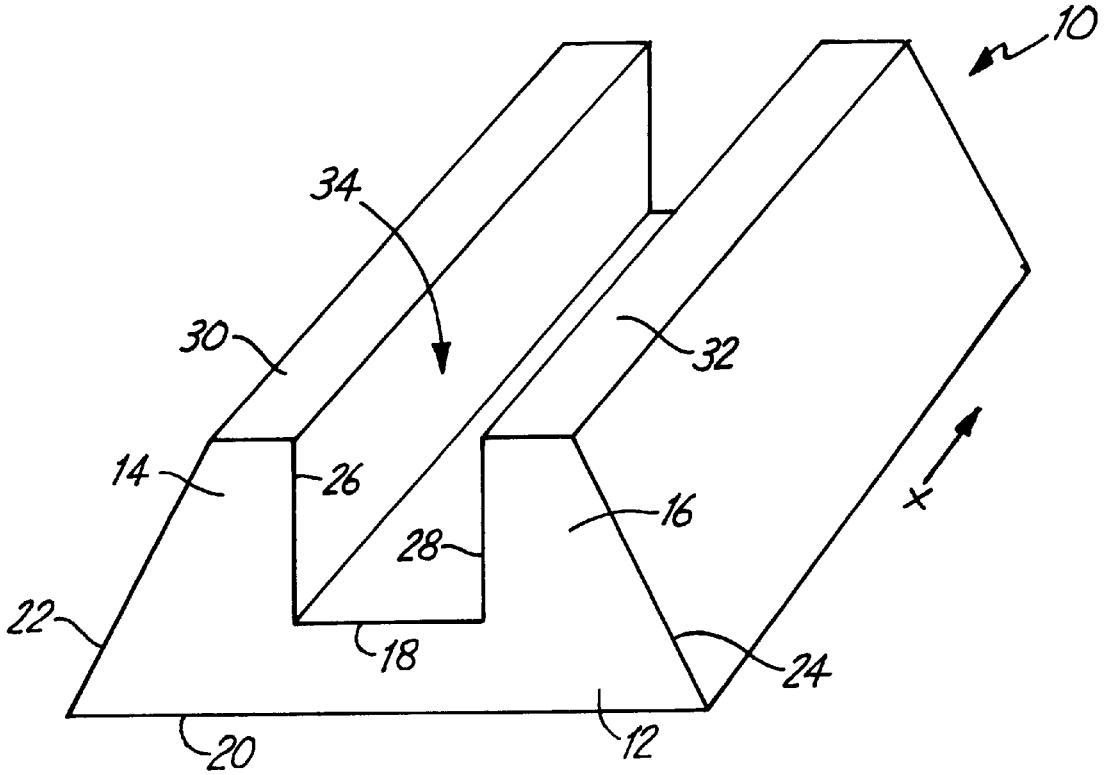
FIG. 1 is a perspective view of a building component in accordance with a first embodiment of the present invention.
Figure 2:
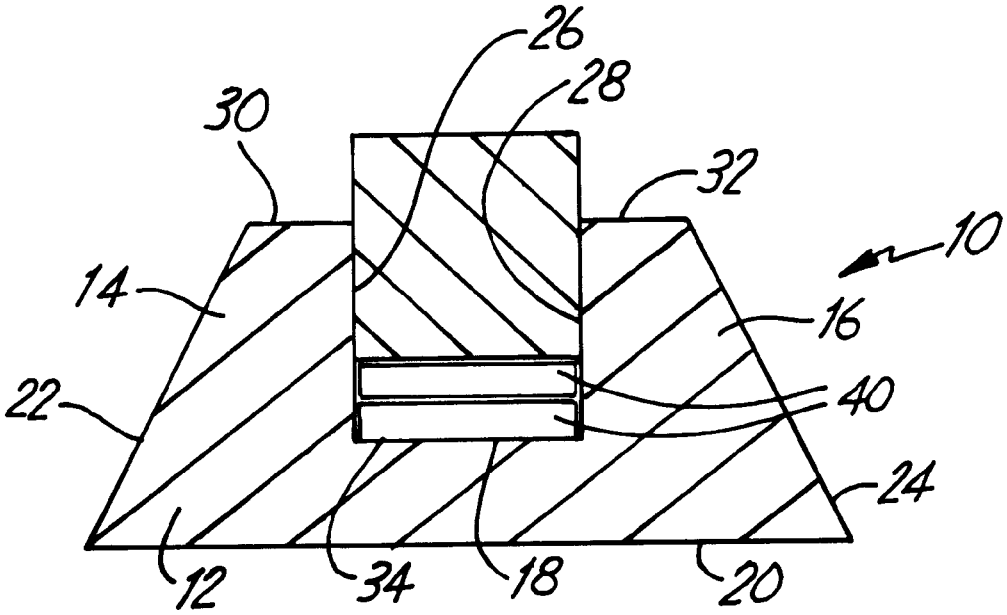
FIG. 2 is a cross-sectional view of the embodiment of FIG. 1 when in use.

Referring to FIG. 1 there is shown a building component 10 comprising a base element 12 and two upwardly projecting side members 14 and 16. The building component 10 may be of any convenient dimension in the longitudinal direction X however, in cross-section and as shown in FIG. 2, the base element 12 can be seen to be bounded by an upper surface 18 and a somewhat larger lower surface 20 as well as by inclined side walls 22 and 24. The inclined side walls 22 and 24 subtend an included angle at the lower surface 20 of between 600° and 800° and extend upwardly from the lower surface to merge with, and partially define, a respective one of the upwardly projecting side members 14 or 16.

As can be seen from FIG. 2, apart from the inclined side walls 22 and 24, the upwardly projecting side members 14 and 16 are each defined by a respective one of a pair of inner side walls 26 and 28 which extend upwardly from opposite ends of the upper surface 18 as well as by a respective top surface 30 or 32. The top surfaces 30 and 32 occupy planes which are substantially parallel both to each other and to those occupied by the upper and lower surfaces 18 and 20 while the two inner side walls 26 and 28 occupy planes which extend substantially perpendicularly to that containing the upper surface 18 so as to thereby define a square based channel 34. The two inner side walls 26 and 28 are preferably spaced apart by a distance of between 3 cm and 5.5 cm so as to enable the square based channel 34 to accommodate a variety of supporting battens. However, in a currently preferred embodiment the inner side walls 26 and 28 are spaced apart by a distance of approximately 4 cm.

In use, and when laying a floor, a plurality of such building components 10 are placed on an underlying structure each with their respective lower surfaces 20 in contact with the structure. Generally speaking the building components 10 are positioned in a number of spaced apart rows. Within each row the building components 10 are again spaced, this time longitudinally, with their respective square based channels 34 aligned so as to define a longitudinal batten path. A plurality of supporting battens are then introduced to the longitudinal batten paths and pushed down between the outwardly projecting side members 14 and 16. If, for some reason, the supporting battens are not at a desired height, one or more height adjusting spacers 40 may be introduced into the square based channels 34 between the supporting battens and the upper surface 18 of the base element 12. Once the supporting battens are in place the desired flooring layer is then laid over the top of the supporting battens and secured in place.

Figure 3:
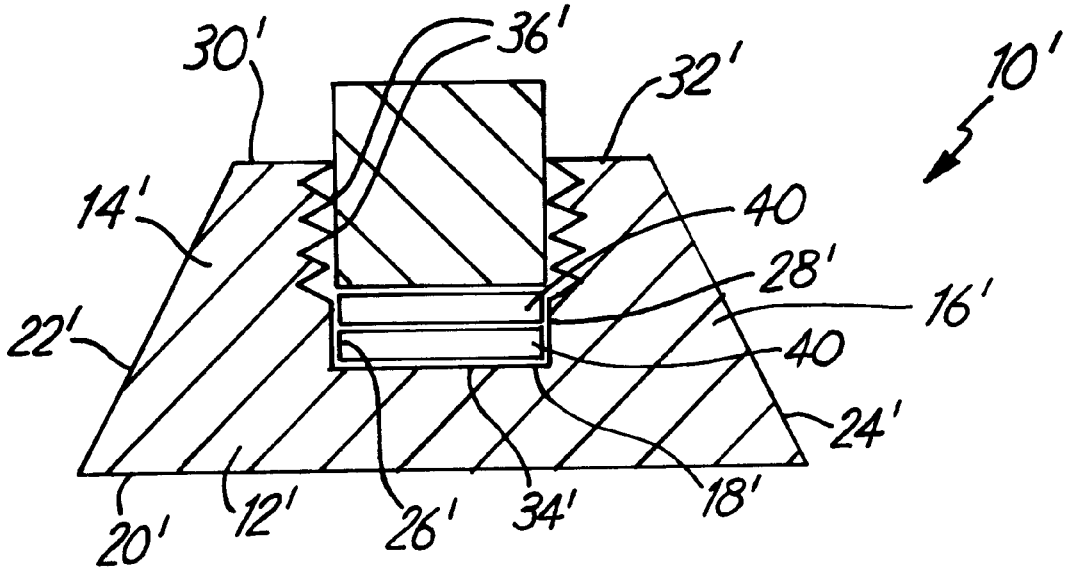
FIG. 3 is a cross-sectional view of a building component in accordance with a second embodiment of the present invention when in use.

In a first embodiment of the present invention, one, but preferably both, of the upwardly projecting side members 14 and 16 are formed of resilient material. In this way the side members are able to deform outwardly to accommodate an oversized supporting batten. At the same time the building component 10 may be dimensioned so that the upwardly projecting side members 14 and 16 deform sufficiently to grip a standard sized supporting batten and thereby hold the batten in place. In another embodiment, shown in FIG. 3, the upwardly projecting side members 14' and 16' are provided on the inner side walls 26' and 28' with one or more laterally extending, resilient projections or ribs 36' specifically designed to engage and grip a supporting batten received within the square based channel 34'.

By forming the upwardly projecting side members 14 and 16 of resilient material, many of the manufacturing problems associated with the components of the prior art may be overcome. For example, it no longer becomes necessary to manufacture the building component 10 to such high tolerances since the ability of the upwardly projecting side members 14 and 16 to deform outwardly enables standard sized supporting battens to be accommodated by square based channels 34 of varying widths. Alternatively, a square based channel 34 of predetermined dimensions may be used to accommodate a variety of different supporting battens. In addition, by deliberately making the square based channel 34 slightly undersize with respect to the standard size of supporting batten, the resilient nature of the upwardly, projecting side members 14 and 16 enables the building component 10 to grip the supporting batten and thereby hold it securely in place without the need for additional fastening means or adhesives. Furthermore, by providing upwardly projecting side members 14 and 16 that are formed of resilient material, the building component 10 is able to absorb any lateral vibrations that are applied to it via the supporting batten and so serves to reduce the transmission of noise within the cavity defined between the flooring layer and the underlying structure.

In another embodiment of the present invention the base element 12 is additionally provided on its lower surface 20 with a layer of resilient material. In this way the building component 10 may also absorb vibrations having a component in a vertical plane and may once again serve to reduce the transmission of noise in the cavity defined between the flooring layer and the underlying structure.

In another embodiment, rather than providing the lower surface 20 with a layer of resilient material, the layer of resilient material may be provided on the upper surface 18. This again has the effect of absorbing vibrations having a component in a vertical plane.

In yet another embodiment, rather than providing either the lower or upper surfaces with a layer of resilient material, the entire base element 12 may be formed of resilient material. Once again this provides the building component 10 with improved sound insulating properties.

Having decided to form the base element 12 of resilient material as well as the upwardly projecting side members 14 and 16, it is clear that the entire building component 10 may be formed of the same material to produce an integral structure. This has the effect of greatly simplifying the manufacturing process which in turn reduces the manufacturing cost.

In one currently preferred embodiment the building component 10 is formed of rubber crumbs each having a nominal diameter of between 1 mm and 4 mm which are bound together by a non-water soluble adhesive to form a matrix. This has the advantage that once the rubber crumbs and the adhesive have been mixed together the building component 10 may be formed in a mould under a nominal closing pressure of, say, 40 kg. Nevertheless, it will be apparent to those skilled in the art that a one piece building component may be formed of resilient material in a number of different ways and furthermore that those building components may have a variety of hardnesses depending on the applications in which they are to find use. For example, the building component may equally be formed of cork or polystyrene or indeed a mixture of one or both of these materials and rubber.

Having said that, one of the advantages of using a resilient material such as rubber is that, unlike the building components of the prior art which have tended to be made of wood or metal, the building component resists vibration and so does not "squeak" when people, or objects, move, or are moved, over the flooring layer above.

Another advantage is that building components formed of resilient material are that much more difficult to damage or break either in use or in storage prior to use. Accordingly, the number of building components lost or damaged due to what may be termed "natural wastage" is considerably reduced.

Yet another advantage of forming the building component entirely of a material such as rubber is that it is unaffected by water. Thus if for whatever reason water should penetrate into the cavity defined between the flooring layer and the underlying structure it at least will not cause any damage to the building components supporting the battens.

As mentioned previously, the building component may be of any convenient length in the longitudinal direction X. However, by forming the building component entirely of a material such as rubber it is possible for a preformed building component to be cut to size on site using nothing more than a sharp knife. This again has implications for manufacturing costs since the building components may be formed in standard lengths and only cut to size when details of their specific use are known.

In an alternative embodiment, each building component 10 may again be formed in standard lengths but be provided with an number of frangible regions along that length thereby enabling part of the component to be torn away to leave a remainder which is of a length suited to the application in hand. In this way even the use of standard workman tools, such as sharp knives, can be avoided.

Alternatively, the building components 10 may be moulded in a grid of x building components by y building components with a frangible region between each building component and its neighbours, thereby enabling any selected building component to be torn away or otherwise removed from the grid.

Another advantage of forming the building component solely of a material such as rubber is that the shape of the building component may easily be modified to fit individual situations, and may be re-sized on site simply by the use of a sharp knife or by a tearing action. For example, a portion of one of the upper side members may easily be removed from the building component so as to accommodate pipework laid in close proximity to a support batten.

Figure 4:
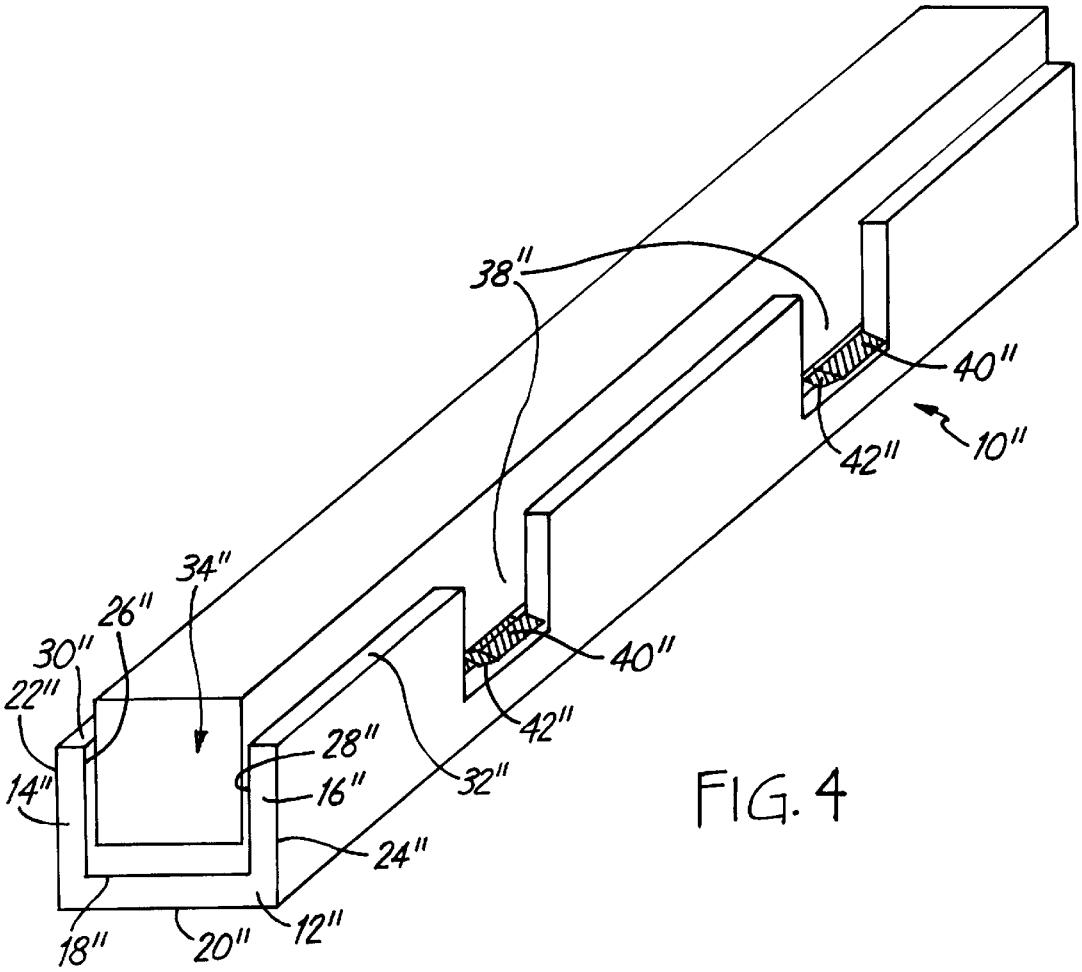
FIG. 4 is a perspective view of a building component in accordance with a third embodiment of the present invention when in use.

In another embodiment illustrated in FIG. 4, the building component 10" is shown to include two apertures 38" in the upwardly projecting side member 16". If desired, similar apertures may also be provided in the other upwardly projecting side member 14" and, although not shown in FIG. 4 these apertures can, if so desired, be in line with the first apertures 38". By providing a building component 10" having one or more apertures 38" in the upwardly projecting side members 14" and 16" it is possible to insert a height adjusting spacer 40" between the supporting batten and the base element 12" even after the supporting batten has been received within the square based channel 34". This greatly simplifies the task of ensuring that the supporting batten, and hence the flooring layer laid on top of the supporting batten, is spaced at the desired distance from the underlying structure.

Figure 5A:
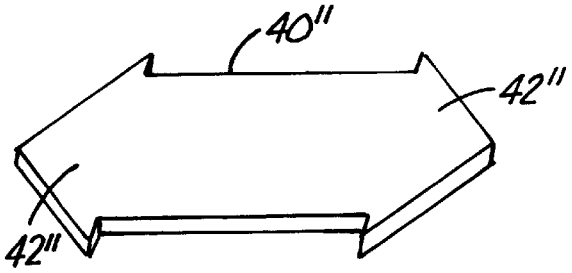
FIG. 5A and 5B are perspective views of a spacer in accordance with further embodiments of the present invention.

In a preferred arrangement illustrated in FIG. 5A, the height adjusting spacer 40" may be provided with one or more barbs 42" to enable the spacer to engage and grip the building component 10" once it has been inserted through the aperture 38". This provides the advantage of avoiding the use of an adhesive or some other means in order to hold the height adjusting spacer 40" in place. Whilst the spacer 40" shown in FFIG. 5A has barbs 42" which extend in the same plane as the rest of the spacer, it will be apparent to those skilled in the art that the barbs 42" may also extend in other planes.

In another arrangement, the height adjusting spacer 40" may be made slightly oversize for the dimensions of the square based channel 34" so that, having been inserted through one of the apertures 38", it is held in place by virtue of the resilient nature of the upwardly projecting side members 14" and 16". In another arrangement, the height adjusting spacer 40" may be made slightly oversize for the dimensions of the apertures 38" so that, once again, having been squeezed through an aperture 38" it is held in place by the resilience of the side members 14" and 16".

Figure 5B:
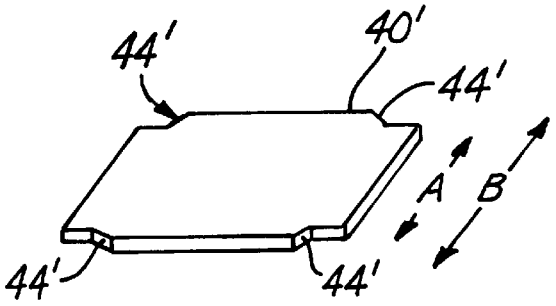

In yet another preferred arrangement illustrated in FIG. 5B, the height adjusting spacer 40' is of a width A at both ends, broadening out to a central width B, where A is less than B and B slightly greater than the width of the aperture 38". Thus, having been squeezed into place through the aperture 38", the spacer is loosely held in place with the central portion of width B resting within the area of the square based channel 34", and the ends of the spacer of width A extending into the apertures 38". To aid insertion, the change in width of the spacer is not at a perpendicular step, but along chamfered edges 44'. One of the advantages of the spacer shown in FIG. 5B over that, say, shown in FIG. 5A is that it is generally planar and so can be stacked on top of another similar spacer to provide a composite spacer of increased height.

In any of the foregoing embodiments, it will be apparent that the spacers themselves may be formed of a resilient material in preference to the building component.

Figure 6:
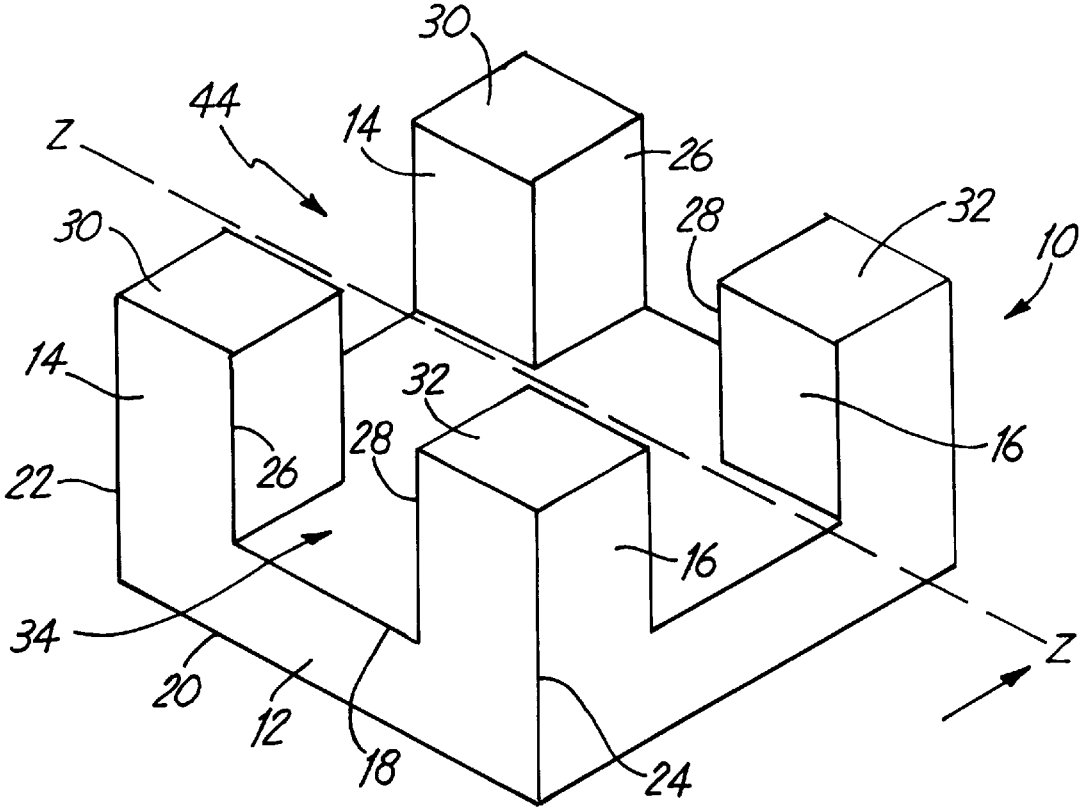
FIG. 6 is a perspective view of a building component in accordance with another embodiment of the present invention.

In yet another embodiment shown in FIG. 6 the building component 10 is provided with upwardly projecting side members 14 and 16 which are shaped so as to define not only a first square based channel 34 but also a second square based channel 44 which extends in a direction transverse to the first square based channel. In this way the building component 10 may be used to simultaneously receive two supporting battens which extend transversely of each other. In a particularly preferred embodiment the upwardly projecting side members 14 and 16 may be shaped so that the second square based channel 44 extends substantially at right angles to the first. In such an embodiment, either the first or second square base channel may also serve to define apertures through which spacers may be inserted in a direction transverse to the supporting batten to be raised.

Figure 7:
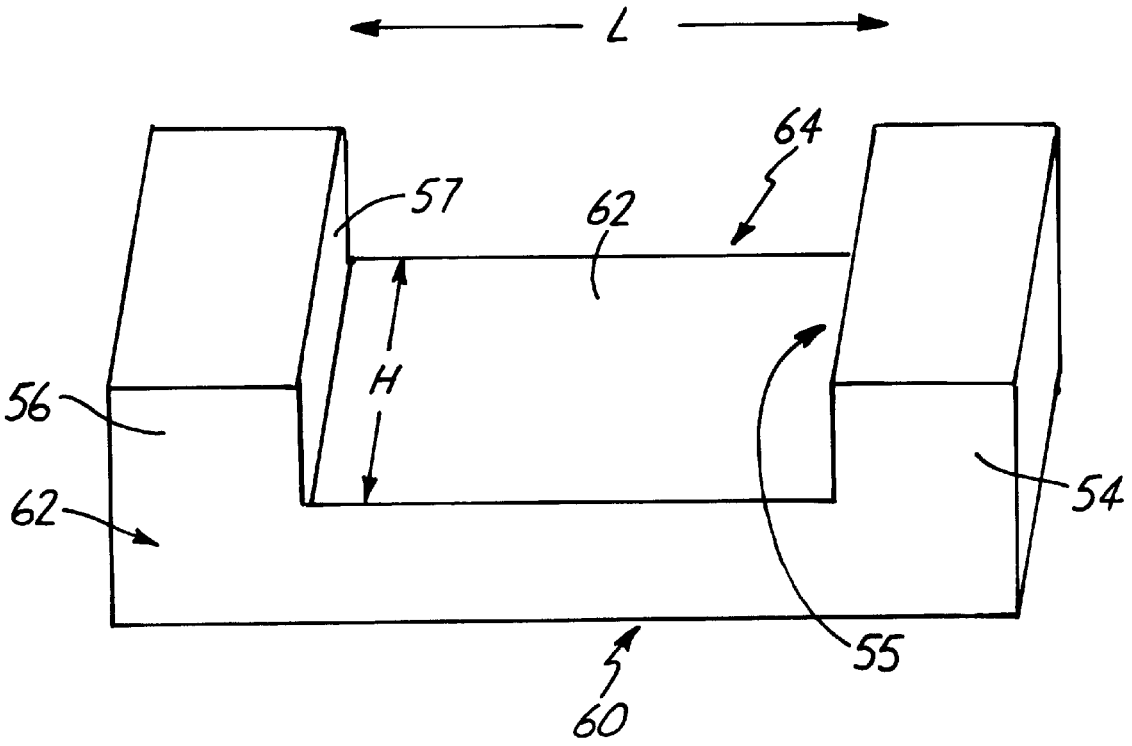
FIG. 7 is a perspective view of a spacer in accordance with another embodiment of the present invention.

Referring to FIG. 7 there is shown another design of spacer 50 comprising a base section 52 and two upwardly projecting side walls 54 and 56. The base section 52 is of generally rectangular cross-section and has a length K, a width M and a height H. By contrast, the two upwardly projecting side walls 54 and 56 define respective opposing surfaces 55 and 57 which are spaced a distance L apart. As a result, the base section 52 and the two upwardly projecting side walls 54 and 56 together define a substantially U-shaped channel in which the base of the channel 58 (defined by that portion of an upper surface of the base section which extends between t he two side walls) has an area of L×M.

Figure 8A:
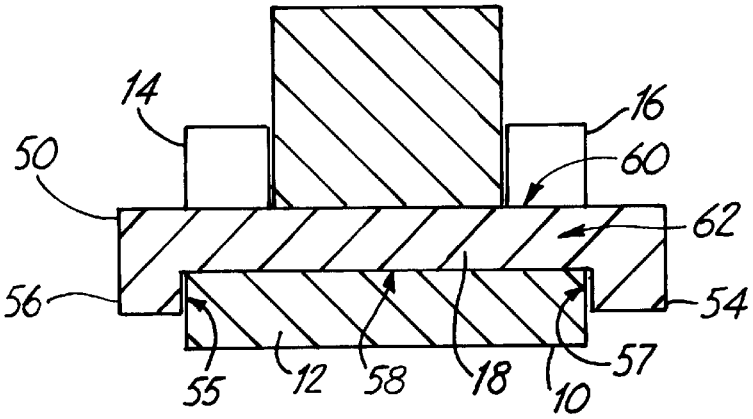
FIGS. 8A and 8B are cross-sectional views of the spacer of FIG. 7 in combination with the building component of FIG. 6.
Figure 8B:
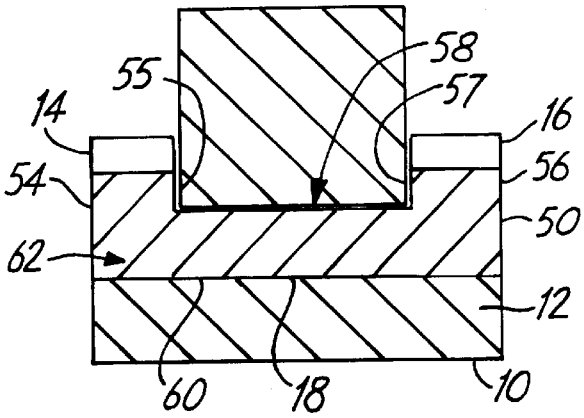

FIG. 8A and 8B show two alter native ways in which spacers of the same general configuration as that shown in FIG. 7 but of different specific dimensions may be used to raise a supporting batten above the level of the base element 12. Such an increase in height may be desirable, for example, to accommodate a layer of sound insulating material between the floor and the underlying structural member.

FIG. 8A shows the spacer 50 resting with the base section 52 overlying the base element 12 of the building component with the base of the channel 58 in engagement with the upper surface 18 and with the spacer side 54 and 56 extending downwardly adjacent side walls 22 and 24. With the spacer 50 located in this way with respect to the building component, the supporting batten rests upon what in FIG. 7 is the lower surface of the base section 52 and is thus raised by a distance H above the base element 12 equivalent to the thickness of the spacer base section 52.

In one preferred embodiment the base element 12 is of a resilient character and the distance L between the spacer side walls 54 and 56 is slightly narrower than the corresponding width of the base element. The resilient nature of the base element 12 thus enables the building component to securely gripped by the spacer 50. Alternatively, one or both of the spacer side walls 54, 56 could be of a resilient character to achieve the same result. In either case the embodiment of FIG. 8A provides the advantage of avoiding the use of an adhesive or some other means in order to hold the spacer in place.

In an alternative embodiment the base section 52 is formed in such a way that the width M is slightly oversized compared to the apertures 38 of the building component. In this arrangement the spacer 50 may be held securely in position by the resilient nature of one or both of the spacer and building component side members 14, 16.

In the illustrated embodiment, the side walls 54 and 56 are seen to extend substantially perpendicularly away from the base section 52 in order to fit securely around the perpendicular edges of the base element 12. However, if the building component should be formed with inclined side walls as illustrated in FIGS. 1 & 2, the side walls 54 and 56 could, of course, also be appropriately inclined with respect to the base section 52 so as to once more locate the spacer with respect to the building component.

In an alternative embodiment illustrated in FIG. 8B, the spacer base section 52 once again overlies the base element 12 of the building component. However, this time it is the lower surface of the base section 52 which is in engagement with the upper surface 18 and the side walls 54, 56 extending upwardly away from the base element 12 rather than downwardly. As a result the spacer provides a channel for the supporting batten to rest within defined by surfaces 55, 57 and 58.

Once again the spacer may be made of resilient material and the distance L between the side walls 54, 56 may be slightly undersized compared to the supporting batten so as to ensure that the batten is securely gripped. At the same time the spacer may be formed with the dimension M slightly oversized with respect to the apertures 38 of the building component. In this way, provided one or both of the spacer and the building component are resilient, the spacer may be held in place by the side members 14 and 16.

In a particularly preferred embodiment, the spacer 50 illustrated in FIG. 7, is formed so that the distance L is such as to enable the U-shaped channel defined by the base section 52 and the side walls 54 and 56 to receive a supporting batten. At the same time the spacer width M is selected so as to equal the distance L thereby rendering the base of the channel 58 square. With this arrangement a first spacer may be positioned on the building component as illustrated in either of FIGS. 8A or FIG. 8B, the support batten removed and a second spacer of identical construction placed at right angles on top the first such that the base of the channel 58 of the second spacer either in contact with what in FIG. 7 is the lower surface of the base section 52 of the first spacer (if the first spacer is in the orientation shown in FIG. 8A) or the base of the channel 58 of the first spacer (if the first spacer is in the orientation shown in FIG. 8B). The supporting batten may then be placed on top of what in FIG. 7 is the lower surface of the base section 52 of the second spacer and as a result is raised by a height 2H equivalent to the combined height of the two spacers.

Figure 9A:
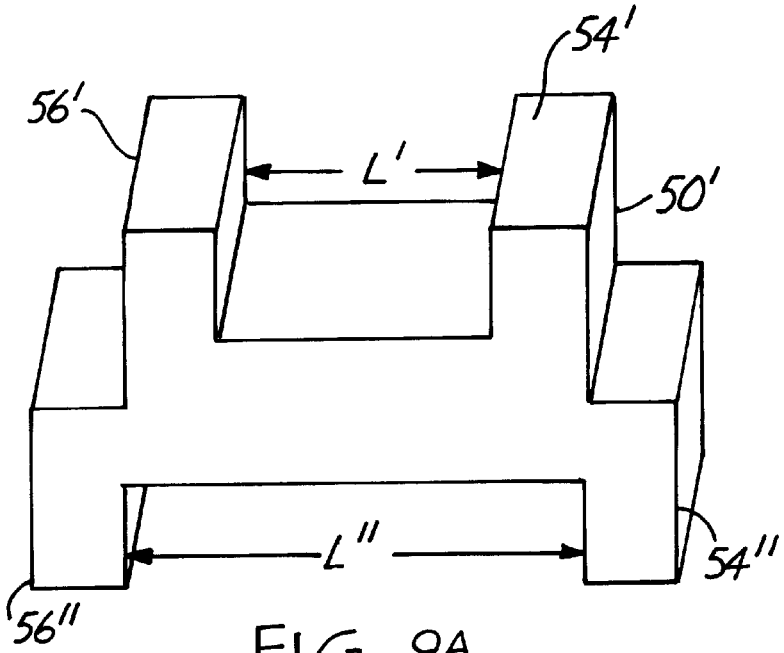
FIGS. 9A and 9B are perspective views of spacers in accordance with further embodiments of the present invention.

In a further embodiment illustrated in FIG. 9A, the two embodiments of FIGS. 8A and 8B are effectively combined into a single integral unit. This further embodiment 50' comprises a base section 52', two upwardly projecting side walls 54' and 56' spaced a distance L' apart so as to accommodate a supporting batten, and two downwardly projecting side walls 54" and 56" spaced a distance L" apart so as to be capable of being seated on a building component base element 12.

Figure 9B:
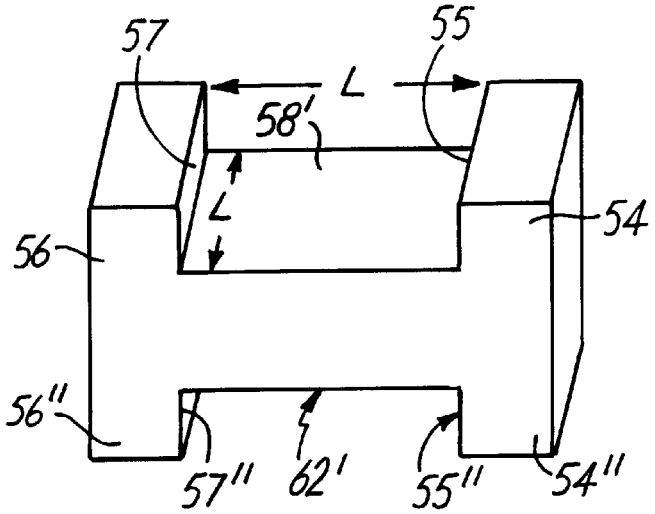
Figure 10:
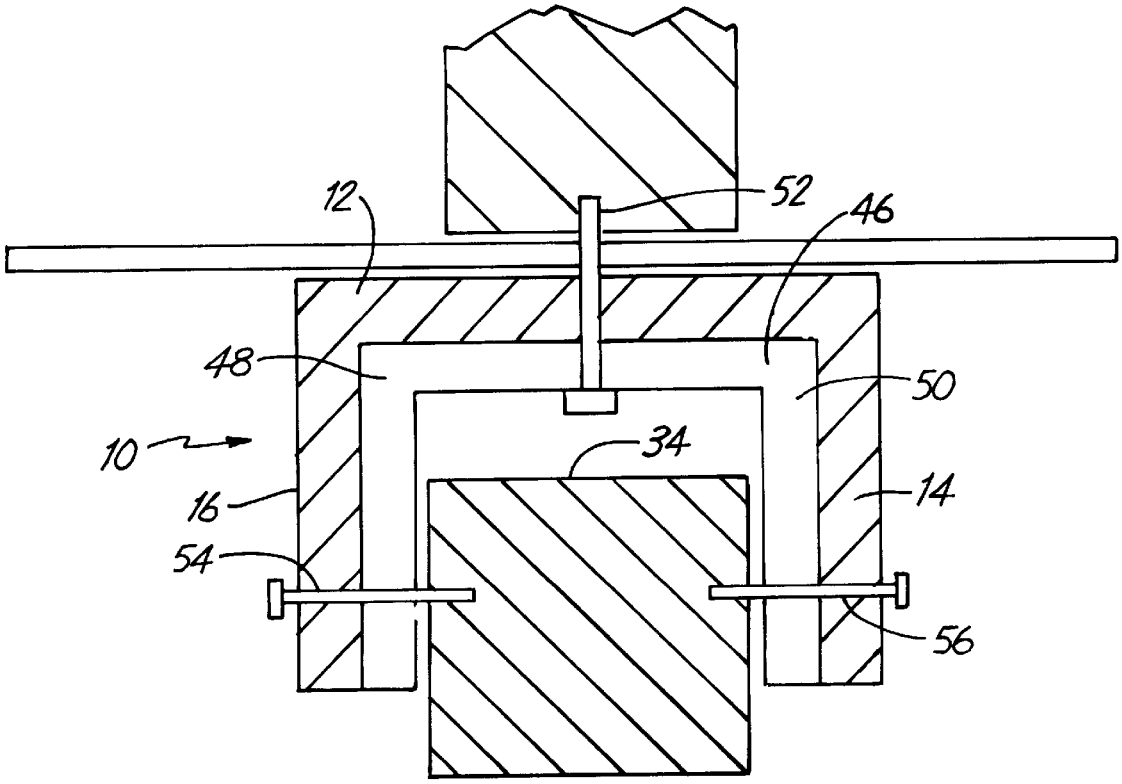
FIG. 10 is a cross-sectional view of a building component in accordance with a further embodiment of the present invention specifically adapted for use with ceilings.

In yet another embodiment illustrated in FIG. 9B, the spacer is effectively composed of two of the spacers illustrated in FIG. 7 placed back-to-back. This embodiment thus comprises a base section 52, two upwardly projecting side walls 54' and 56' spaced a distance L apart so as to accommodate a supporting batten, and two downwardly projecting side walls 54" and 56" also spaced a distance L apart. The base section is also of width L so that the base of the 2 U-shaped channels 58' and 58" defined by the base section 52 and the two pairs of side walls 54' and 56' and 54" and 56" are both square.

With such a construction the spacer of this embodiment may be positioned on top of either of the spacers illustrated in FIGS. 8A or 8B, in the same manner as has been previously described. At the same time the surfaces 55', 57' and 58' define an upper U-shaped channel either for receiving a supporting batten or for receiving a further H-shaped spacer of identical construction but oriented at right angles to the first.

In this way; by stacking a suitable number of H-shaped or U-shaped spacers on top of each other, it is possible to space the supporting batten (and hence the subsequent floor, wall or ceiling) at any desired distance from the underlying structural member.

As will be apparent, any number of the planar or barbed spacers illustrated in FIGS. 5A and 5B may also be used in conjunction with the H-shaped or U-shaped spacers of FIGS. 7 to 9B in order to "fine tune" the supporting batten to be the desired distance from the structural member.

Although the present building component 10 has been described almost exclusively in conjunction with floors, it will be apparent to those skilled in the art that it may also find use with walls and ceilings in much the same way. In each case what has been referred to as the lower surface 20 is placed in contact with the underlying structure of the wall or ceiling and secured thereto by any suitable means. A supporting batten is then introduced into the square based channel 34 and the distance between the supporting batten and the underlying structure adjusted by inserting one or more spacers between the batten and the base element 12. Once the supporting batten is at the desired distance from the underlying structure one or more surface panels are secured to the supporting batten to define the desired wall or ceiling.

Where the building component 10 is to be used with ceilings, it may incorporate a metal reinforcing member 46 of substantially C-shaped cross-section. As can be seen from FIG. 6, the reinforcing member 46 is preferably embedded within the building component with the limbs of the reinforcing member 48 and 50 extending on either side of the square based channel 34 and generally parallel to the inner sidewalls 26 and 28. In this way the building component 10 may be secured to the underlying ceiling structure by means of a suitable fastener 52 passing through an aperture in the reinforcing member 46 while the supporting batten may be retained within the square based channel 34 by further fasteners 54 and 56 passing through the limbs of the reinforcing member 48 and 50.

Although the present building component 10 has been described as being of a particular cross-section, it will be apparent to those skilled in the art that the present invention is not limited to the cross-sectional shape shown in the accompanying drawings. For example, the side walls 22 and 24 need not subtend an included angle at the lower surface 20 of between 60° and 80°. Instead they may extend substantially perpendicularly to the lower surface 20 so as to no longer be inclined.

Likewise, although the side members 14 and 16 have been described as being capable of deforming resiliently by virtue of the material of which they are formed in a direction transverse to that of the square based channel 34, it will again be apparent to those skilled in the art that this need not be the case. In another embodiment the side members may be provided with a mechanical construction which enables them to deform resiliently in the same direction whilst they themselves are formed of a non-resilient material.

It will also be apparent to those skilled in the art that the present invention is not limited to a building component comprising solely one pair of mutually spaced side members 14 and 16. In another embodiment (not shown) the building component may be provided with a third side member which extends in a direction parallel to the other two. This third side member may be spaced from the central "side member" so as to define a second square based channel of differing width but which nevertheless extends in the same direction as the first. In this way the one building component may be used to accommodate supporting battens of greatly differing dimensions.

What is claimed is:

1. A building component in combination with one or more spacers, the building component comprising a base element adapted to be positioned on a surface of a building structure and a pair of mutually spaced side members which project from the base element to define a longitudinal channel for the receipt of a supporting batten to which a further surface layer may be secured, at least one of said side members defining an aperture and at least one of the building component and the or each spacer being adapted such that the or each spacer is or are inserted through the aperture in a direction transverse to the longitudinal channel and between the base element and the supporting batten and subsequently retained in the inserted position.

2. The invention of claim 1, wherein the or each spacer is substantially planar.

3. The invention of claim 1, wherein the or each spacer is shaped so that, once inserted between the base element and the supporting batten, a first dimension of the spacer inhibits movement of the spacer in a direction parallel to the longitudinal channel and a second dimension of the spacer inhibits movement of the spacer in a direction parallel to the direction of insertion.

4. The invention of claim 1, wherein the or each spacer is provided with one or more barbs with which to engage the building component and hold the spacer in position.

5. The invention of claim 1, wherein the building component comprises one or more frangible regions spaced at intervals along the length of the channel.

6. The invention of claim 1, wherein one or both of the side members of the building component are adapted to deform resiliently in a direction transverse to that of the channel.

7. The invention of claim 1, wherein one or both of the side members are provided with one or more projections which extend into the channel and which are adapted to resiliently engage the supporting batten received thereby.

8. The invention of claim 1, wherein one or both of the side members are formed of resilient material.

9. The invention of claim 1, wherein the base element is provided with a layer of resilient material on a surface of the base element such that, in use, the resilient material is interposed between the base element and the building structure.

10. The invention of claim 1, wherein the base element is provided with a layer of resilient material on a surface of the base element such that, in use, the resilient material is interposed between the base element and the supporting batten.

11. The invention of claim 1, wherein the base element is formed of resilient material.

12. The invention of claim 1, wherein the building component is integrally formed of resilient material.

13. The invention of claim 1, wherein the building component is formed of rubber.

14. The invention of claim 1, wherein the building component is formed of a plurality of rubber crumbs which are bound together in a matrix by adhesive.

15. The invention of claim 1, wherein the side members are shaped so as to define a second channel for the receipt of a second supporting batten, the second channel extending in a direction transverse to the first.

16. The invention of claim 1, wherein the building component comprises one or more reinforcing members embedded in one or both of the base element and the side members.

17. A floor, wall or ceiling comprising a plurality of building components and spacers, each building component comprising a base element adapted to be positioned on a surface of a building structure and a pair of mutually spaced side members which project from the base element to define a longitudinal channel for the receipt of a supporting batten to which a further surface layer may be secured, at least one of said side members defining an aperture and at least one of the building component and the or each spacer being adapted such that one or more spacers are inserted through the aperture in a direction transverse to the longitudinal channel and between thee base element and the supporting batten and subsequently retained in the inserted position;

said building components being positioned in a plurality of spaced rows over a surface of a building structure and longitudinally spaced within each row with the channels aligned to define a longitudinal batten path, one or more supporting battens disposed along said batten path, one or more spacers interposed between said supporting battens and said building components, and one or more elements of a surface layer secured to the supporting batten to form said floor, wall or ceiling.

18. A method of constructing a floor, wall or ceiling comprising the steps of positioning in a plurality of spaced rows over a surface of a building structure a plurality of building components and spacers, each building component comprising a base element adapted to be positioned on a surface of a building structure and a pair of mutually spaced side members which project from the base element to define a longitudinal channel for the receipt of a supporting batten to which a further surface layer may be secured, at least one of said side members defining an aperture and at least one of the building component and the or each spacer being adapted to allow the insertion of one or more spacers through the aperture in a direction transverse to the longitudinal channel and between the base element and the supporting batten and to subsequently retain the or each spacer in the inserted position;

spacing the building components longitudinally within each of said rows and aligning the channels defined by the building components so as to define a longitudinal batten path;

inserting one or more supporting battens along said batten path;

inserting one or more spacers through said apertures in a direction transfer to said batten path and between said supporting battens and said building components; and securing one or more elements of a surface layer to the supporting battens to form said floor, wall or ceiling.

19. The method of claim 18 comprising the additional step of stacking an additional spacer on top of an existing spacer to increase the distance between the surface of the building structure and said floor, wall or ceiling.

20. The method of claim 18, wherein a building component comprises one or more frangible regions spaced at intervals along the length of the channel, and the method of comprises the additional step of:

reducing the building component to the desired length by breaking one ore more of said frangible regions.

* * * * *

UNITED STATES PATENT AND TRADEMARK OFFICE

CERTIFICATE OF CORRECTION

PATENT NO. : 6,026,623
DATED : February 22, 2000
INVENTOR(S) : Keith James Hunter Anderson It is certified that error appears in the above-identified patent and that said Letters Patent is hereby corrected as shown below:

Claims:

Column 14,
Line 13, "transfer" should be -- transverse --.
Line 27, "ore" should be -- or --.

Signed and Sealed this

Fourteenth Day of August, 2001

*Attest:*

Nicholas P. Godici

*Attesting Officer*

NICHOLAS P. GODICI
*Acting Director of the United States Patent and Trademark Office*

UNITED STATES PATENT AND TRADEMARK OFFICE

CERTIFICATE OF CORRECTION

PATENT NO. : 6,026,623
DATED : February 22, 2000
INVENTOR(S) : Keith James Hunter Anderson It is certified that error appears in the above-identified patent and that said Letters Patent is hereby corrected as shown below:

Title page,
Item [73] Assignee: delete "Bolt Wade & Tennant, London, United Kingdom" insert -- INSTAFIBRE LIMITED, Finchampstead, United Kingdom --.

Signed and Sealed this

Nineteenth Day of February, 2002

*Attest:*

*Attesting Officer*

JAMES E. ROGAN
*Director of the United States Patent and Trademark Office*